US008567374B2

(12) United States Patent
Shimoyama et al.

(10) Patent No.: US 8,567,374 B2
(45) Date of Patent: Oct. 29, 2013

(54) INTERNAL COMBUSTION ENGINE

(75) Inventors: Kazuaki Shimoyama, Wako (JP); Kenji Tsukahara, Wako (JP); Kazuhiro Matsui, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 903 days.

(21) Appl. No.: 12/669,869

(22) PCT Filed: Jul. 15, 2008

(86) PCT No.: PCT/JP2008/001895
§ 371 (c)(1),
(2), (4) Date: Feb. 18, 2010

(87) PCT Pub. No.: WO2009/034672
PCT Pub. Date: Mar. 19, 2009

(65) Prior Publication Data

US 2010/0154753 A1 Jun. 24, 2010

(30) Foreign Application Priority Data

Sep. 10, 2007 (JP) ..... 2007-234304

(51) Int. Cl.
*F02B 47/08* (2006.01)
*F02M 25/07* (2006.01)

(52) U.S. Cl.
USPC ..... 123/568.13; 123/568.11

(58) Field of Classification Search
USPC ..... 123/568.11, 568.13, 568.17; 60/605.2
See application file for complete search history.

(56) References Cited

U.S. PATENT DOCUMENTS

| | | | | |
|---|---|---|---|---|
| 6,478,017 | B2 * | 11/2002 | Bianchi | 123/568.12 |
| 6,971,378 | B2 * | 12/2005 | Mackey et al. | 123/568.13 |
| 7,069,918 | B2 * | 7/2006 | Mackey et al. | 123/568.12 |
| 8,210,157 | B2 * | 7/2012 | Sohn et al. | 123/568.13 |
| 2009/0120418 | A1 * | 5/2009 | Eibl et al. | 123/568.12 |
| 2012/0285427 | A1 * | 11/2012 | Hayman et al. | 123/568.11 |

FOREIGN PATENT DOCUMENTS

| | | | |
|---|---|---|---|
| EP | 0 985 819 | A2 | 3/2000 |
| JP | 63-9618 | A | 1/1988 |
| JP | 6-50222 | A | 2/1994 |
| JP | 8-210150 | A | 8/1996 |
| JP | 8-218950 | A | 8/1996 |
| JP | 10-159664 | A | 6/1998 |
| JP | 10-196393 | A | 7/1998 |
| JP | 11-082185 | A | 3/1999 |

* cited by examiner

*Primary Examiner* — Stephen K Cronin
*Assistant Examiner* — Sizo Vilakazi
(74) *Attorney, Agent, or Firm* — Arent Fox LLP

(57) ABSTRACT

The present invention provides an internal combustion engine comprising an engine body 100, an overhang 101 projecting from a cylinder row end the engine body 100 and extending from an intake side 21 to an exhaust side 23 of the engine body, and an EGR pipe 41 disposed in a space 102 defined under the overhang 101 with a gap 103 between the EGR pipe 41 and the cylinder row end of the engine body, thereby avoiding the excessive cooling of EGR gas passing through the EGR pipe 41 while reducing a length of a passage defined by the EGR pipe 41, and preventing members disposed near the EGR pipe 41 from being damaged by heat.

9 Claims, 4 Drawing Sheets

INTERNAL COMBUSTION ENGINE

TECHNICAL FIELD

The present invention relates to an internal combustion engine, and in particular to a layout and surrounding structure of an exhaust gas recirculating passage member of an internal combustion engine for recirculating exhaust gas.

BACKGROUND OF THE INVENTION

An internal combustion engine used for automobiles generally comprises a plurality of cylinders defined in an engine body which consists of a cylinder block and a cylinder head, an intake manifold or an intake air passage member provided on an intake side of the engine body defined on one side of the engine body with respect to a cylinder row direction, and an exhaust manifold or an exhaust air passage member provided on an exhaust side of the engine body with respect to the cylinder row direction.

In order to improve the exhaust gas performance, internal combustion engines which conduct exhaust gas recirculation (EGR) are provided with exhaust gas recirculating passage members for recirculating the exhaust gas from the exhaust side to the intake side.

As one example of the exhaust gas recirculating passage, there is a passage defined by an exhaust gas recirculating pipe (EGR pipe) disposed so as to pass beside a cylinder row end of the engine body or over the cylinder head cover, communicating the passage defined by the intake manifold with the passage defined by the exhaust manifold (for example, see Japanese patent application publication No. H8-218950). Another example of the exhaust gas recirculating passage is a passage with its main part being an internal passage passing through the cylinder head from the intake side to the exhaust side (for example, see Japanese patent application publication H11-82185).

BRIEF SUMMARY OF THE INVENTION

In the configuration where the EGR pipe is disposed so as to pass beside the cylinder row end of the engine body, the exhaust gas recirculating passage becomes longer, and thus the temperature decrease of the exhaust gas passing through the exhaust gas recirculating passage (EGR gas) becomes greater, which leads to decrease in combustion temperature, thereby deteriorating combustion of the internal combustion engine.

In the configuration where the EGR pipe passes over the cylinder head cover, compared with the configuration where the EGR pipe passes beside the cylinder row end of the engine body, the length of the exhaust gas recirculating passage can be configured to be shorter, thereby preventing decrease in the temperature of the EGR gas passing through the exhaust gas recirculating passage.

In this configuration, however, since there are many plastic members with low heat resistance disposed on the cylinder cover such as air cleaner and intake tube, when the EGR pipe gets heated, these members disposed on the cylinder head cover will be exposed to the heat of the exhaust gas passing the EGR pipe, and thus their durability and performance will deteriorate. Therefore, members disposed near the EGR pipe will be damaged by heat. In addition, this configuration requires a space for disposing EGR pipe, thereby limiting the freedom degree of the layout of the frontal part of the vehicle.

On the other hand, if the main part of the exhaust gas recirculating passage is an internal passage passing through the cylinder head from the intake side to the exhaust side, the length of the exhaust gas recirculating passage can be configured to be shorter, however, during cold start-warm up process there is a risk that the EGR gas may be excessively cooled by the cylinder head which is cooled and has a large heat capacity. This will lead to decrease in combustion temperature, thereby deteriorating combustion quality of the internal combustion engine.

The problem that this invention proposes to solve is to prevent the EGR gas from being excessively cooled while reducing the length of the exhaust gas recirculating passage member (EGR pipe), and to prevent members disposed near the exhaust gas recirculating passage member from being damaged by heat.

The internal combustion engine according to the present invention, comprises an engine body defining a plurality of cylinders, an intake passage member provided on an intake side of the engine body defined on one side of the engine body with respect to a cylinder row direction, an exhaust passage member provided on an exhaust side of the engine body defined on the other side of the engine body with respect to the cylinder row direction, and an exhaust gas recirculating passage member communicating a passage defined by the intake passage member with a passage defined by the exhaust passage member so as to recirculate exhaust gas from the exhaust side to the intake side, wherein the engine body includes an overhang projecting from a cylinder row end thereof and extending from the intake side to the exhaust side, and wherein the exhaust recirculating passage member is disposed in a space defined under the overhang with a gap defined between the exhaust gas recirculating passage member and the cylinder row end of the engine body.

In the internal combustion engine according to the present invention, the exhaust gas recirculating passage member has a non-facing side not facing the cylinder row end of the engine body or a wall of the overhang, and the internal combustion engine further comprises a heat shield plate covering the non-facing side without touching the same.

In the internal combustion engine according to the present invention, preferably, the heat shield plate is attached to the overhang at an upper end thereof, and extends downward therefrom so as to define a passage accommodating space through which the exhaust gas recirculating passage member passes, the passage accommodating space including the space defined under the overhang.

In the internal combustion engine according to the present invention, preferably, the cylinder row end of the engine body is provided with a fuel pump mounting surface at a position higher than an attachment site where the heat shield plate is attached to the overhang, and the heat shield plate defines a passage accommodating space and extends so as to spatially separate the fuel pump mounting surface from the exhaust gas recirculating passage member.

In the internal combustion engine according to the present invention, the cylinder row end of the engine body is provided with a rib projecting in a same direction as a projecting direction of the overhang at a position higher than the attachment site where the heat shield plate is attached to the overhang and lower than the fuel pump mounting surface.

In the internal combustion engine according to the present invention, preferably, an edge of the rib is disposed more outward than the attachment site where the heat shield plate is attached to the overhang.

In the internal combustion engine according to the present invention, preferably the rib has an inclining portion inclining with respect to a vertical direction, and the heat shield plate has a concave portion recessed toward a base end of the rib and located under a lowest point of the inclining portion of the rib.

In the internal combustion engine according to the present invention, preferably, the heat shield plate is attached to the cylinder row end of the engine body at the concave portion thereof by using a threaded bolt.

In the internal combustion engine according to the present invention, preferably, the exhaust gas recirculating passage member does not contact the engine body so that there is no direct heat conduction between the exhaust gas recirculating member and the engine body.

According to the internal combustion engine of the present invention, as the exhaust gas recirculating passage member is disposed in the space defined under the overhang with a gap between itself and the cylinder row end of the engine body, especially during cold start-warm up process, there is no risk of heat loss of the exhaust gas recirculating passage member by thermal conduction from the exhaust gas recirculating passage member to the engine body, which is cooled by cooling water passing through a cooling water passage formed inside the cylinder block and cylinder head and thus has a large heat capacity. Therefore, the EGR gas passing through exhaust gas recirculating passage member can be prevented from being excessively cooled.

In addition, by effectively using the space defined under the overhang, which is a dead space, the length of the exhaust gas passage member can be configured to be shorter than other conventional pipes passing outside the engine body, and at the same time, space occupied by the exhaust gas recirculating passage member can be reduced, thereby avoiding reduction of the freedom degree of the engine room layout.

Furthermore, as the exhaust gas recirculating passage member is disposed in the space defined under the overhang, the overhang provides a barrier effect inhibiting the upward heat diffusion from the exhaust gas recirculating member. This prevents the heat damage of members disposed near the exhaust gas recirculating passage member.

DETAILED DESCRIPTION OF THE PREFERRED EMBODIMENTS

Figure 1:
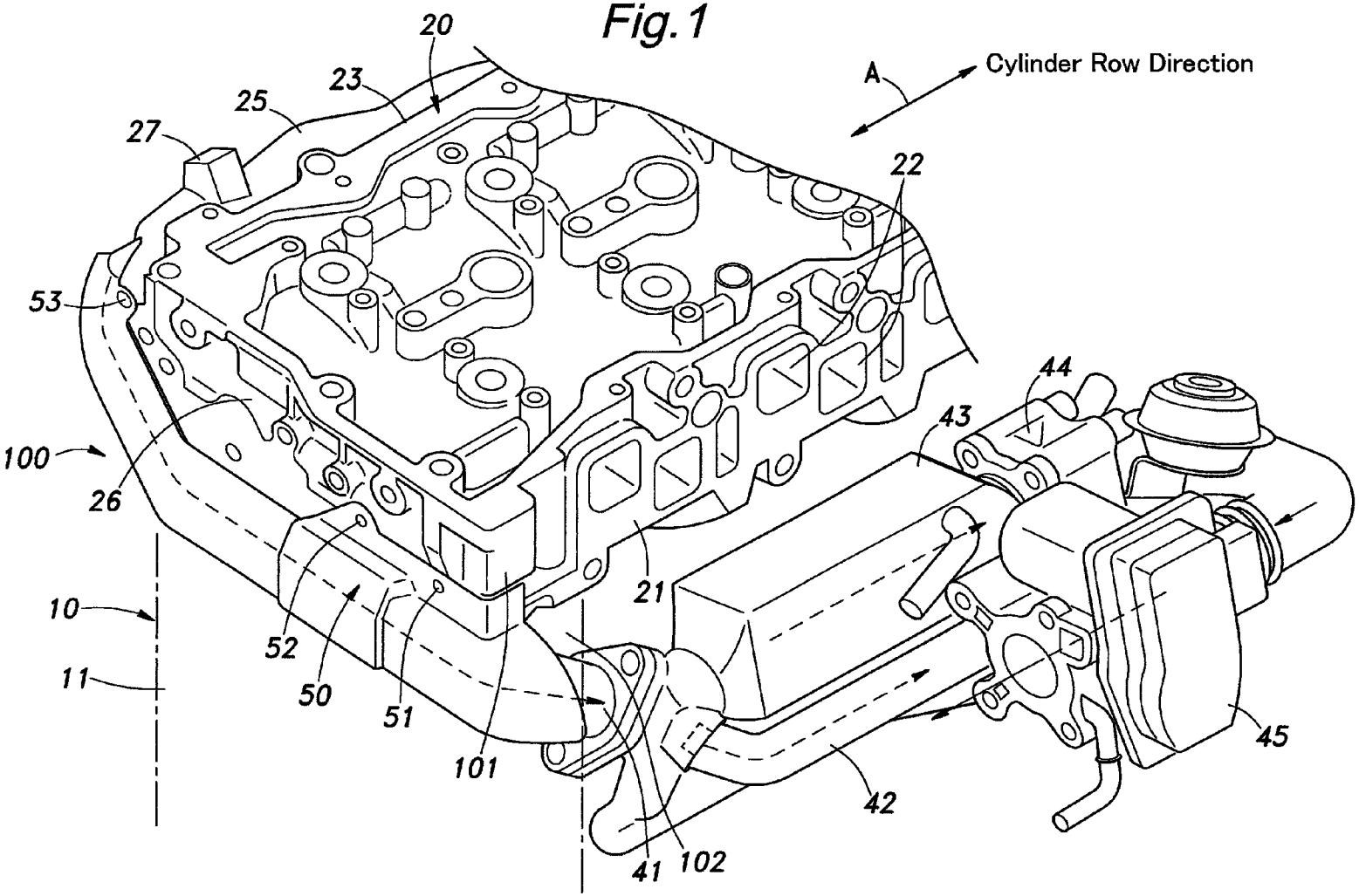
FIG. 1 is a perspective view showing the main parts of the internal combustion engine according to the present invention in one embodiment.
Figure 2:
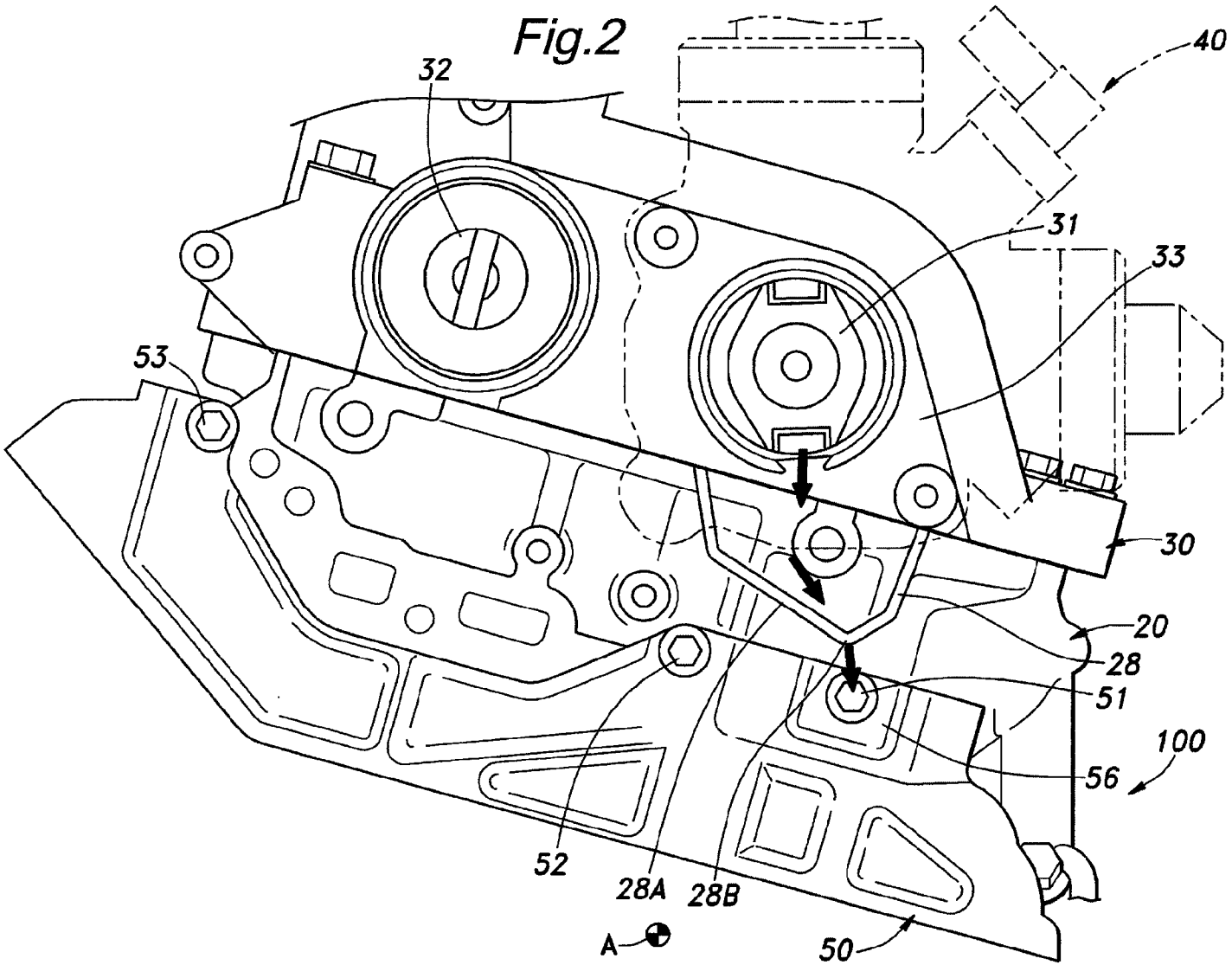
FIG. 2 is an enlarged front view showing the main parts of the internal combustion engine according to the present invention in the same embodiment.
Figure 3:
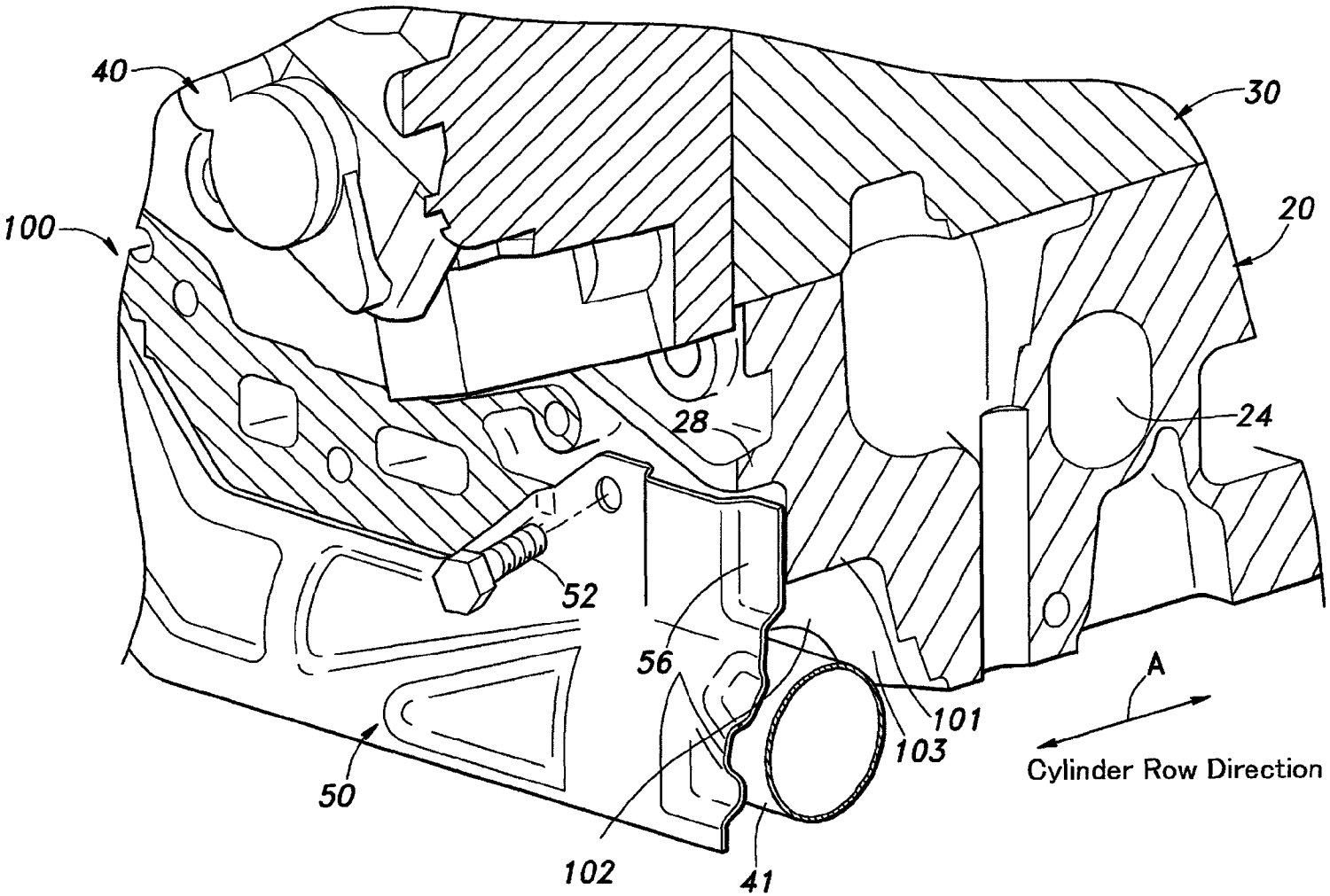
FIG. 3 is an enlarged perspective view showing the main parts of the internal combustion engine according to the present invention in the same embodiment.
Figure 4:
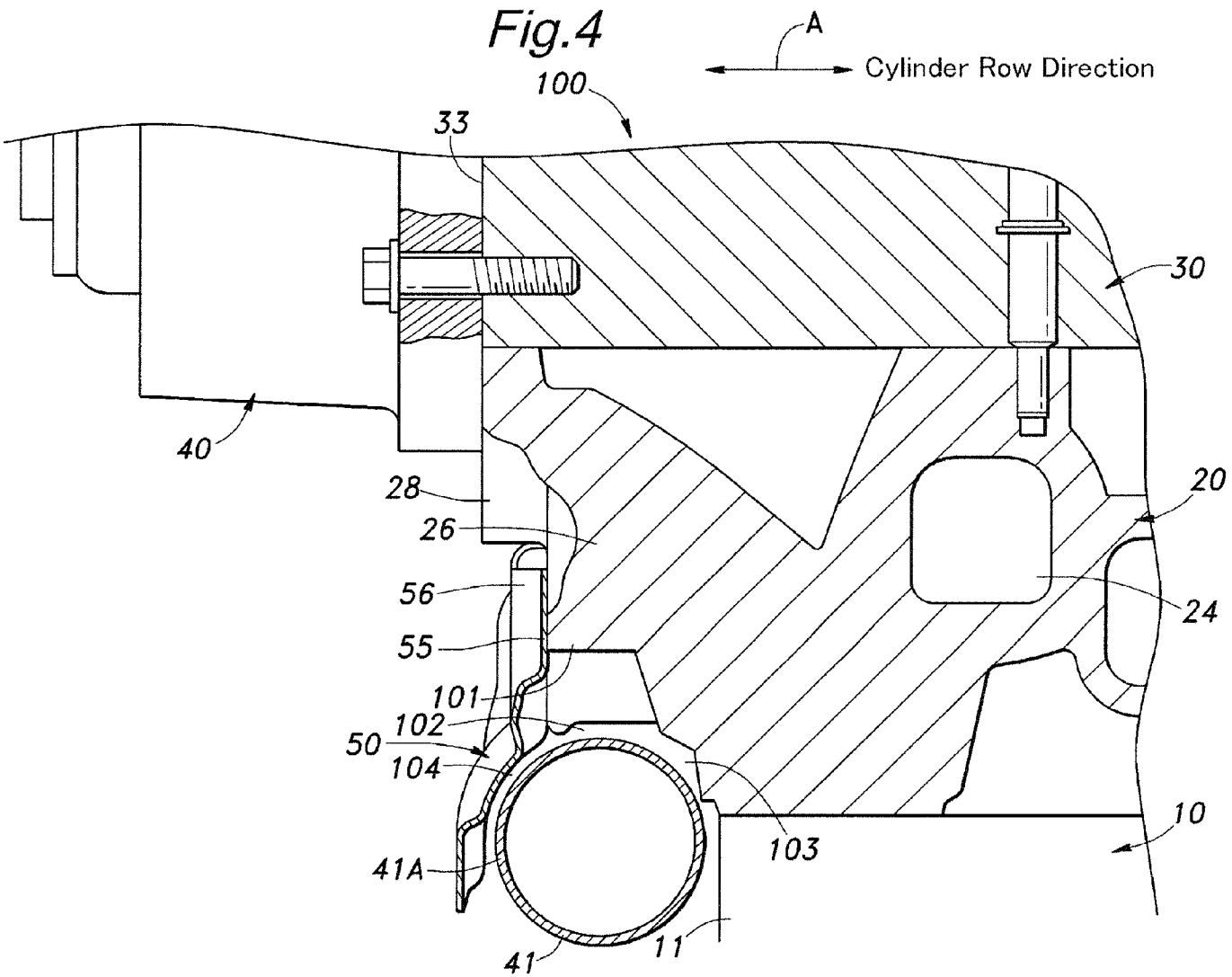
FIG. 4 is an enlarged sectional view showing the main parts of the internal combustion engine according to the present invention in the same embodiment.

Next, an embodiment of the internal combustion engine according to the present invention is described with a reference of FIGS. 1-4.

An engine body 100 comprises a cylinder block 10, a cylinder head 20 mounted on the cylinder block 10, and a cam holder 30 mounted on the cylinder head 20.

The cylinder block 10 has a plurality of cylinder bores (not shown) formed therein, and defines a plurality of cylinders arranged in one line along with the cylinder head 20 which covers the cylinder block 10. The row direction of the plurality of cylinders is represented by an arrow A in these figures.

The cylinder head 20 has intake ports 22 for the cylinders formed on an intake side 21 of the engine body defined on one side of the engine body with respect to the cylinder row direction A. The cylinder head 20 also has exhaust ports (not shown) for the cylinders formed on an exhaust side 23 of the engine body defined on the other side of the engine body with respect to the cylinder row direction A. In addition, the cylinder head 20 is provided with a cooling water passage 24 formed therein.

The cylinder head 20 is provided with an intake manifold (not shown) or an intake air passage member on the intake side 21 of the engine body, and an exhaust manifold 25 or an exhaust air passage member on the exhaust side 23 of the engine body.

Cylinder head 20 is provided with an overhang 101 projecting from an end 26 thereof with respect to cylinder row direction A (cylinder row end 26) and extending in a direction from the intake side 21 to the exhaust side 23 of the engine body. The overhang 101 is formed by projecting an upper portion of the cylinder row end 26 of the cylinder head 20 more outward relative to the engine body than an end 11 of the cylinder block 10 with respect to the cylinder row direction A (cylinder row end 11), and thus defines a space 102 thereunder. The overhang 101, in this embodiment, is almost uniformly formed from the intake side 21 to the exhaust side 23 of the engine body. The cylinder row end 11 of the cylinder block 10 and the lower portion of the cylinder row end 26 of the cylinder head 20 form an almost continuous surface.

The cam holder 30 supports camshafts 31 and 32 of the engine valve system. The cam holder 30 is provided with, at an end thereof with respect to the cylinder row direction A, a fuel pump mounting surface 33 for mounting a fuel pump 40 thereon. The fuel pump mounting surface 33 is disposed in a position higher than that of the overhang 101. The fuel pump 40 is connected to the camshaft 31 in a drivable manner, and thus is rotated by the camshaft 31.

The internal combustion engine comprises exhaust gas recirculating system formed by EGR pipes 41 and 42, EGR gas cooler 43, EGR bypass valve 44, and EGR valve 45, which are exhaust gas recirculating members. These members communicate the passage defined by the intake manifold (not shown) with the passage defined by the exhaust manifold 25, and thus recirculate the exhaust gas from the exhaust side to the intake side.

The EGR pipe 42, EGR gas cooler 43, EGR bypass valve 44, and EGR valve 45 are disposed near the intake side 21 of the engine body and in proximity with the intake manifold (not shown) provided on the intake side 21 of the engine body.

The EGR pipe 41 has its major portion disposed in the space 102 defined under the overhang 101, and the passage defined by the EGR pipe 41 is communicated with an EGR port 27 formed on the exhaust manifold 25 at one end thereof and with an end of a passage defined by the other EGR pipe 42 disposed in a lower position than that of the EGR pipe 41 at the other end thereof. In addition, the EGR pipe 41 does not touch the engine body 100 directly or indirectly (for example, there is no stay connecting the intermediate portion of the EGR pipe 41 with the engine body 100), and thus there is no direct heat conduction between the EGR pipe 41 and the engine body 100.

Specifically, the EGR pipe 41 extends almost parallel to a direction from the exhaust side 23 to the intake side 21 of the engine body and is disposed in the space 102 defined under the overhang 101, defining a gap 103 along with the end 11 of the cylinder block 10 and the end 26 of the cylinder head 20.

Therefore, the EGR pipe 41 is disposed such that it passes beside the end of the engine body with a short length.

A cylinder row end of the overhang 101, which is a part of the cylinder row end 26 of the cylinder head 20, is provided with a heat shield plate 50 attached thereto. The heat shield plate 50 is attached to cylinder row end of the overhang 101 at an upper end thereof with threaded bolts 51, 52 and 53 and extends downward therefrom toward the space 102 defined under the overhang 101 so as to define an EGR pipe accommodating space 104 which includes the space 102 defined under the overhang 101.

The heat shield plate 50 covers a non-facing side 41A of the EGR pipe 41, which is a portion of the EGR pipe 41 that does not face the end 26 of the cylinder head 20 or the overhang 101, without contacting the same. The heat shield plate 50 defines the EGR pipe accommodating space 104 along with the end 26 of the cylinder head 20 and the overhang 101 and spatially separates the fuel pump mounting surface 33 from the mounting space of the EGR pipe (EGR pipe accommodating space 104).

In this embodiment, the EGR pipe 41 partially protrudes from the space 102 defined under the overhang 101, and the heat shield plate 50 is configured to curve outward relative to the engine body so as to cover the part of the EGR pipe 41 which protrudes from the space 102 defined under the overhang 101 without touching the same.

The end 26 of the cylinder head 20 is provided with a rib 28 at a position higher than an attachment site 55 where the heat shield plate 50 is attached to the end 26 of the cylinder head 20 and lower than the fuel pump mounting surface 33. The rib 28 is formed so as to project in a same direction as a projecting direction of the overhang 101 from the end 26 of the cylinder 20. The rib 28 has a V-letter shape as seen from the front (elevation) and projects more outward than the attachment site 55. Since the rib 28 has V-letter shape as seen from the front (elevation), it has an inclining portion 28A inclining with respect to a vertical direction.

The heat shield plate 50 has a concave portion 56 formed thereon under a lowest point 28B of the inclining portion 28A of the rib 28 and recessed toward a base end of the rib 28. The heat shield plate 50 is attached at the concave portion 56 to the end 26 of the cylinder head 20 using a threaded bolt 51.

The internal combustion engine with the configuration described above provides the following advantages:

(1) As the EGR pipe 41 is disposed in the space 102 defined under the overhang 101 with the gap 103 between itself and the engine body 100, especially during cold start-warm up process, there is no risk of heat loss of the EGR pipe 41 by thermal conduction from the EGR pipe 41 to the engine body 100, which is cooled by cooling water passing through cooling water passage 24 formed inside the cylinder block 10 and cylinder head 20 and thus has a large heat capacity. Therefore, the EGR gas passing through the EGR pipe 41 can be prevented from being excessively cooled.

In addition, by effectively using the space 102 defined under the overhang 101, which is a dead space, the length of the EGR pipe 41 can be configured to be shorter than other conventional EGR pipes passing outside the engine body, and at the same time, space occupied by the EGR pipe 41 can be reduced, thereby avoiding reduction of the freedom degree of the engine room layout.

Furthermore, as the EGR pipe 41 is disposed in the space 102 defined under the overhang 101, the overhang 101 provides a barrier effect inhibiting upward heat diffusion from the EGR pipe 41. This prevents members near the EGR pipe 41 from being damaged by heat, thereby reducing performance degradation and durability loss of these members.

(2) Since the heat shield plate 50 covers the non-facing side 41A of the EGR pipe 41 which does not face the end 26 of the cylinder head 20 or the overhang 101 without contacting the same, the upward heat diffusion from the EGR pipe 41 can be inhibited more effectively.

(3) As the heat shield plate 50 is attached to the overhang 101 at upper end thereof and extends downward therefrom toward the space 102 defined under the overhang 101, defining the EGR pipe accommodating space 104 which includes the space 102 defined under the overhang 101, radial heat diffusion from EGR pipe 41 to the engine room can be prevented. Moreover, as the heat released from the EGR pipe 41 is trapped in the EGR pipe accommodating space 104, temperature decrease of the EGR gas passing the EGR pipe 41 can be prevented.

(4) As the fuel pump mounting surface 33 where the fuel pump 40 is mounted is provided at a position higher than the overhang 101 mounted to the end of the engine body and the heat shield plate 50 spatially separates the fuel pump mounting surface 33 from the mounting space of the EGR pipe 41, when removing the fuel pump, oil or fuel dripping from the fuel pump mounting surface 33 can be prevented from reaching the EGR pipe 41.

(5) As the rib 28 is formed at a position higher than the attachment site 55 where the heat shield plate 50 is attached to the end of the engine body and lower than the fuel pump mounting surface 33 such that it projects in the same direction as the projecting direction of the overhang 101 from the end of the engine body, oil or fuel flowing on the surface of the end of the engine body can be conducted away from the heat shield plate 50, thereby preventing them from reaching and fouling the heat shield plate 50.

(6) As the rib 28 projects more outward than the attachment site 55 where the heat shield plate 50 is attached to the end of the engine body, oil or fuel can be prevented from reaching the EGR pipe accommodating space 104 through the gap between the heat shield plate 50 and the end of the engine body at the attachment site 55.

(7) As the rib 28 has the inclining portion 28A inclining in a vertical direction, and the heat shield plate 50 is provided with the concave portion 56 formed thereon under the lowest point 28B of the inclining portion 28A of the rib 28 and recessed toward the base end of the rib 28, oil or fuel can be further prevented from infiltrating into the EGR pipe accommodating space 104 through the gap between the heat shield plate 50 and the end of the engine body at the attachment site 55.

(8) As the heat shield plate 50 is attached at the concave portion 56 to the end of the engine body using the bolt 51, oil or fuel can be prevented from infiltrating into the EGR pipe accommodating space 104 through the gap between the heat shield plate 50 and the end of the engine body at the attachment site 55 even more.

(9) As the EGR pipe 41 does not touch the engine body 100, nor is there, for example, a stay connecting its intermediate portion with the engine body 100, there is no direct heat conduction between the EGR pipe 41 and the engine body 100. Therefore, heat loss of the EGR pipe 41 by heat conduction from the EGR pipe 41 to the engine body 100, which has a large heat capacity, can be prevented even more.

It should be noted that the present invention is not limited to the embodiment described above and it is apparent that variations and modifications can be effected within the spirit of the scope of the present invention. For example, the space 102 defined the overhang 101 can accommodate other EGR components such as the EGR gas cooler 43, the EGR bypass valve 44, and the EGR valve 45.

In addition, the overhang 101 does not need to be almost uniform from the intake side 21 to the exhaust side 23 of the engine body and may be partially-provided to the end of the engine body.

Moreover, in the embodiment described above, although the EGR pipe 41 partially protrudes from the space 102 defined under the overhang 101, in another embodiment, the EGR pipe 41 may not protrude from the space 102 defined under the overhang 101, depending on the size of the overhang 101 and the EGR pipe 41.

In the embodiment described above, although the overhang 101 is formed by projecting the upper part of the cylinder row end 26 of the cylinder head 20, and the EGR pipe 41 is disposed in the space 102 defined under the overhang 101, the lower part of the cylinder row end 26 may be recessed and the EGR pipe 41 may be disposed in the recessed portion.

In addition, the overhang 101 may be formed by projecting the entire cylinder row end 26 of the cylinder head 20 more outward relative to the engine body than the cylinder row end 11 of the cylinder block 10. In this case, the lower surface of the overhang 101 is positioned at almost at the same height as that of the joint surface between the cylinder block 10 and cylinder head 20.

The invention claimed is:

1. An internal combustion engine, comprising:

an engine body defining a plurality of cylinders;

an intake passage member provided on an intake side of the engine body defined on one side of the engine body with respect to a cylinder row direction;

an exhaust passage member provided on an exhaust side of the engine body defined on the other side of the engine body with respect to the cylinder row direction; and an exhaust gas recirculating passage member communicating a passage defined by the intake passage member with a passage defined by the exhaust passage member so as to recirculate exhaust gas from the exhaust side to the intake side;

wherein the engine body includes an overhang projecting from a cylinder row end thereof and extending from the intake side to the exhaust side; and wherein the exhaust recirculating passage member is disposed in a space defined under the overhang with a gap defined between the exhaust gas recirculating passage member and the cylinder row end of the engine body.

2. The internal combustion engine according to claim 1, wherein the exhaust gas recirculating passage member has a non-facing side not facing the cylinder row end of the engine body or a wall of the overhang, and the internal combustion engine further comprises a heat shield plate covering the non-facing side without touching the same.

3. The internal combustion engine according to claim 2, wherein the heat shield plate is attached to the overhang at an upper end thereof, and extends downward therefrom so as to define a passage accommodating space through which the exhaust gas recirculating passage member passes, the passage accommodating space including the space defined under the overhang.

4. The internal combustion engine according to claim 2, wherein the cylinder row end of the engine body is provided with a fuel pump mounting surface for mounting a fuel pump at a position higher than an attachment site where the heat shield plate is attached to the overhang, and the heat shield plate defines a passage accommodating space and extends so as to spatially separate the fuel pump mounting surface from the exhaust gas recirculating passage member.

5. The internal combustion engine according to claim 4, wherein the cylinder row end of the engine body is provided with a rib projecting in a same direction as a projecting direction of the overhang at a position higher than the attachment site where the heat shield plate is attached to the overhang and lower than the fuel pump mounting surface.

6. The internal combustion engine according to claim 5, wherein an edge of the rib is disposed more outward than the attachment site where the heat shield plate is attached to the overhang.

7. The internal combustion engine according to claim 5, wherein the rib has an inclining portion inclining with respect to a vertical direction, and the heat shield plate has a concave portion recessed toward a base end of the rib and located under a lowest point of the inclining portion of the rib.

8. The internal combustion engine according to claim 7, wherein the heat shield plate is attached to the cylinder row end of the engine body at the concave portion thereof by using a threaded bolt.

9. The internal combustion engine according to claim 1, wherein the exhaust gas recirculating passage member does not contact the engine body so that there is no direct heat conduction between the exhaust gas recirculating member and the engine body.

* * * * *